US006059578A

United States Patent [19]

Arnett

[11] Patent Number: 6,059,578

[45] Date of Patent: May 9, 2000

[54] SELECTABLE COMPATIBILITY ELECTRICAL CONNECTOR ASSEMBLY

[75] Inventor: Jaime Ray Arnett, Fishers, Ind.

[73] Assignee: Lucent Technologies Inc., Murray Hill, N.J.

[21] Appl. No.: 09/322,876

[22] Filed: May 28, 1999

[51] Int. Cl.[7] ..... H01R 29/00

[52] U.S. Cl. ..... 439/43; 439/188; 439/676; 439/260

[58] Field of Search ..... 439/43, 676, 260, 439/344, 64, 57, 577, 188, 536

[56] References Cited

U.S. PATENT DOCUMENTS

| | | | |
|---|---|---|---|
| 5,181,858 | 1/1993 | Matz et al. | 439/188 |
| 5,419,717 | 5/1995 | Abendschein et al. | 439/577 |
| 5,562,493 | 10/1996 | Ferrill et al. | 439/536 |
| 5,997,329 | 12/1999 | Kosmala | 439/260 |

*Primary Examiner*—Steven L. Stephan
*Assistant Examiner*—Son V. Nguyen

[57] ABSTRACT

A selectable compatibility electrical connector assembly for use in a high performance communication connection has a plug and a jack which mate together in the high performance mode. The plug has a printed wiring board (PWB) therein which is movable in longitudinal translation. The PWB has, on a surface thereof printed circuitry for altering the electrical characteristics and a plurality of conductive leads in contact with the surface. The PWB has a first position where the leads are in contact with the circuitry and a second position where they contact no circuitry. The jack has members therein which engage the PWB and move it from the first position to the second position when the plug is inserted into the jack, and which return the PWB to the first position when the plug is removed from the jack.

14 Claims, 5 Drawing Sheets

TABLE 10 - 9

UTP CONNECTING HARDWARE NEXT LOSS

| FREQUENCY (MHZ) | CATEGORY 3 (DB) | CATEGORY 4 (DB) | CATEGORY 5 (DB) |
|---|---|---|---|
| 1.0 | 58 | 65 | 65 |
| 4.0 | 46 | 58 | 65 |
| 8.0 | 40 | 52 | 62 |
| 10.0 | 38 | 50 | 60 |
| 16.0 | 34 | 46 | 56 |
| 20.0 | -- | 44 | 54 |
| 25.0 | -- | -- | 52 |
| 31.25 | -- | -- | 50 |
| 62.5 | -- | -- | 44 |
| 100.0 | -- | -- | 40 |

*FIG. 3*

SELECTABLE COMPATIBILITY ELECTRICAL CONNECTOR ASSEMBLY

RELATED APPLICATIONS

This application is related to, and deals with subject matter similar to that of U.S. patent applications Ser. Nos. 09/236,754; 09/236,755; and 09/236,757 of Jaime R. Arnett, filed Jan. 25, 1999, the disclosures of which are incorporated herein by reference.

FIELD OF THE INVENTION

The present invention relates generally to electrical connectors and, more particularly, to a modular connector of the type used in telecommunications equipment.

BACKGROUND OF THE INVENTION

Telecommunication equipment has benefited from the design of electrical plugs and jacks that provide easy connect/disconnect capability between electrical circuits within the telecommunications equipment and, for example, local network wiring. Such plugs and jacks are particularly popular in association with telephone sets, where they were first used, and, more recently, in association with a large variety of peripheral equipment that is connected to telephone lines. The modular plugs and jacks in use today have been standardized, insofar as their performance specifications are concerned and also insofar as certain critical dimensions and structural features are concerned. The use of these devices has become so widespread that new houses and other buildings are prewired with jacks located throughout the various rooms as well as other strategic locations, to accommodate the communication equipment. Where large numbers of such connections are needed, it is typical practice to route the wires to a central location, such as a communication closet where, typically, the jacks are mounted on patch panels. Such an arrangement is shown, for example, in U.S. Pat. No. 5,096,439 of J. R. Arnett. In most installations, it is desirable that the jack be compact, and there have been numerous jacks designed to achieve this goal. In U.S. Pat. No. 5,096,442 of J. R. Arnett there is shown one such compact jack and plug arrangement. The compact electrical connector shown in that patent includes a metallic lead frame mounted to a spring block. The lead frames comprise a number of flat elongated conductors, each terminating in a spring contact at one end and an insulation displacement connector at the other end. The insulation displacement connectors are folded around opposite side walls of the spring block and achieve compactness, and the spring contacts are folded around the front surface of the spring block for insertion into a jack frame. The front surface of the spring block includes a tongue-like projection which fits into one end of the jack frame and interlocks therewith. With the ever increasing numbers of peripheral equipment, and with concomitant increases in operating frequencies, such as required in digital data transmission, connector assemblies such as shown in the aforementioned Arnett '442 patent, while enjoying a large amount of commercial success, do not function well in the higher frequency ranges. The use of such plugs and jacks is impaired by crosstalk within the components, especially in the plug, and as frequencies increase, so does the effect of crosstalk. Numerous arrangements have been proposed for reducing the effects of crosstalk overall by connectors having a minimum of crosstalk, or by connectors which add compensating crosstalk to the overall circuit, such as adding capacitance to the jack to nullify or compensate for the crosstalk in the plug. In U.S. Pat. No. 5,186,647 of W. J. Denkmann et al., there is shown an electrical connector for conducting high frequency signals in which the input and output terminals are interconnected by a pair of metallic lead frames mounted on a dielectric spring block. The lead frames, which are substantially identical to each other each comprises several flat elongated conductors, terminating in spring contacts at one end and insulation displacement connectors at the other end. The conductors are generally parallel and close to each other, but three conductors of one frame are arranged to overlap three conductors of the other frame in a crossover region. As a result, the crosstalk between the several conductors is reduced, due to the reversal in polarities caused by the crossovers.

Nevertheless, for a wide range of applications, an electrical connector having even less crosstalk would be desirable. In particular, the rate of data flow, which is continually being increased in the art today, causes the wiring parts to become, in effect, antennae which both broadcast and receive electromagnetic radiation, thereby, in effect, coupling different pairs of wires together, (crosstalk), thereby degrading the signal-to-noise ratio, and producing an increased error rate. Connectors which, in effect, nullify or at least reduce overall crosstalk, and yet which are usable over wide frequency ranges, are desiderata to which the present invention is addressed. In order for wide frequency usage to be possible, it is desirable that at least some of the components of the connector be compatible with components of connectors in both the low and the high performance categories.

SUMMARY OF THE INVENTION

The present invention, in a preferred embodiment thereof, comprises a connector assembly of an elongated plug and a jack, which are designed to operate together as a high performance connector, but which automatically introduce capacitance into the connection circuit when used as a low performance connector to alter the crosstalk performance and transmission loss characteristic thereof. The terms "high" and "low" are terms of art and relate to several connector parameters, chief among which is crosstalk, as will be discussed more fully hereinafter. It is desirable, for optimum performance, that the plug and the jack operate together in the desired frequency range. Thus a low performance jack should operate with a low performance plug, and a high performance jack should operate with a high performance plug.

In greater detail, the plug has mounted therein a printed wiring board or other crosstalk source, such as a capacitance generating lead frame, discrete capacitances, etc., which is movable in longitudinal translation. On one surface of the wiring board, or PWB, are a plurality of spaced capacitance contact pads in a first region of the PWB, the number being dependent upon the number of leads to which it is desired to add capacitance. Wire contact leads in the plug which, as in normal practice, wrap around the nose of the plug, have contact portions which bear against the surface of the PWB, and against the capacitance pads of the PWB in a first position thereof, or simply against the non-conducting region of the surface of the board in a second position thereof substantially or completely free of circuit elements. The PWB, which is planar in configuration, has a notch on either side thereof adjacent its front end, i.e., the end which is adjacent the nose of the plug. The notches are adapted to be engaged by actuating members comprising first and second cantilevered spring arms in the mating high performance jack, on either side of the opening therein which receives the nose of the plug. The PWB, when engaged by the spring arms, is forced from its first position to the rear of the plug to its second position, removing the capacitance contact pads from the contact portions of the wire leads, which continue to bear against the surface of the PWB in a region thereof which has no circuitry. Thus, the plug is in its high performance configuration, inserted within a high performance jack.

When the plug is removed from the jack, the spring arms remain engaged to the PWB so that it is moved forward relative to the plug to its first, or low performance position. As the plug continues to be pulled out of the jack, the spring arms release the PWB, leaving the plug in its low performance configuration. The plug is then usable with an ordinary low performance jack with the capacitance pads in the circuit, which remain so when the plug is inserted in an ordinary low performance jack.

The jack of the invention can be used with a low performance plug, which, when inserted into the jack, simply pushes the spring arms to the sides of the jack opening into recesses which accommodate the arms in a "stowed" configuration.

As a consequence of the structural features as just described, use of the high performance plug of the invention with the high performance jack of the invention results in no additional capacitance being added, but where a low performance plug is used with the jack of the invention, the jack functions as a low performance jack with added capacitance. Thus, the plug and the jack of the invention function together as a high performance connector, yet each automatically adapts to use with low performance components. The pressure and friction of the contact portion of the leads in the plug is sufficient to hold the PWB in position so that there is no inadvertent shifting or movement thereof between the two positions. Further, when the plug and jack of the invention are mated, the jack applies additional force to the contact leads by means of the spring contacts in the jack.

The numerous principles and features of the present invention, as well as the structural details thereof, will be more readily understood from the following detailed description, read in conjunction with the accompanying drawings.

DESCRIPTION OF THE DRAWINGS

FIG. 3 is a table of industry standards for near end crosstalk loss in connecting hardware;

DETAILED DESCRIPTION

Figure 1:
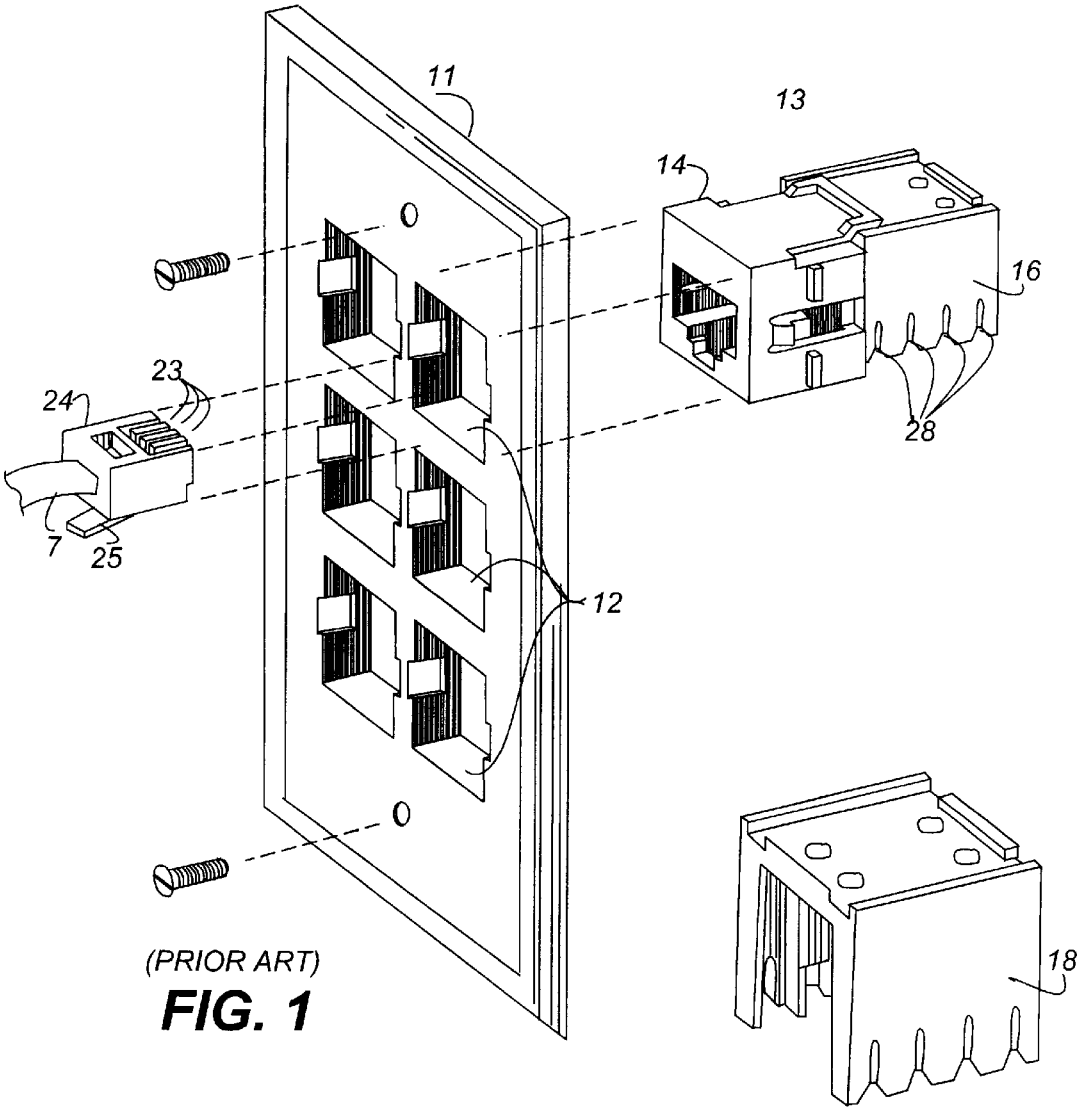
(PRIOR ART) FIG. 1
FIG. 1 is a perspective view of a prior art wall plate with a standard type connector comprising a plug and a jack.
Figure 2:
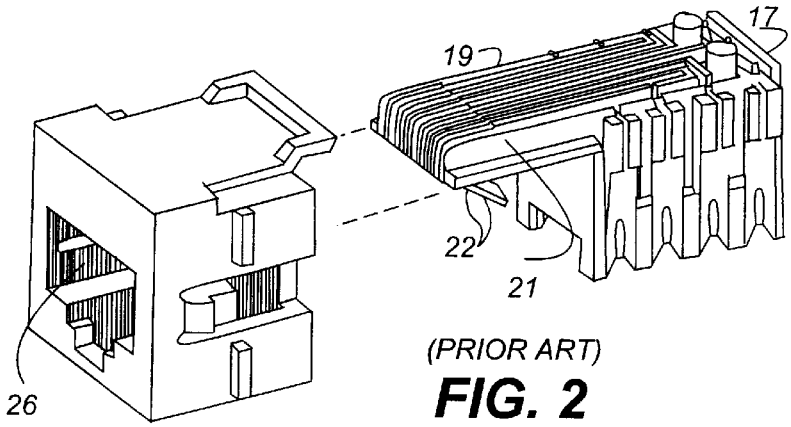
(PRIOR ART) FIG. 2
FIG. 2 is an exploded perspective view of the details of the jack of FIG. 1.

FIG. 1 depicts a prior art wall plate 11 such as is show in the aforementioned Arnett '442 patent, which has openings 12 therein for receiving up to six modular jacks 13. As shown in the Arnett patent, jack 13 comprises a jack frame 14 and a connector 16 which, together, constitute modular jack 13. As can be seen in FIG. 2, connector 16 comprises a spring block member 17 and a cover member 18. Spring block 17 has a wire frame 19 mounted thereon, the leads of which curve around the nose 21 of the spring block 17 and depend at an angle therefrom to form a plurality of spring contacts 22, which mate with contact members 23 in the plug 24 when it is inserted into the opening 26 of jack frame 14 and locked by means of trigger or latching arm 25. The contact members 23 are each connected to an individual wire in cable 27, and the spring contacts 22 are each connected to an individual wire 28 which may be part of a cable, not shown, or which may lead to individual apparatus, not shown. The plug 24 and the jack 13 may form connections for a number of wires such as, for example, four or eight, depending upon the particular application. Wire frame 19 is shown in FIG. 2 as having eight wires, and, hence, eight spring contacts 22, which plug 24 is shown as having only four contact numbers. It is to be understood that FIG. 2 does not depict a specific connector hook-up, but is intended to illustrate the relationship of the various parts or components of the connector module. The arrangement of FIGS. 1 and 2 has been modified in numerous ways, as pointed out hereinbefore, in efforts to improve the near end crosstalk (NEXT) performance, achieve greater compactness, or to facilitate the operation of connection/disconnection in usage. In all such cases, the actual connect/disconnect operation of the apparatus is basically the same, even where the plugs or jacks have been modified extensively for whatever reason. In other words, the industry standards have to be met.

The present invention is a connector system which is intended to extend the performance range of operation but which complies with industry standards to the extent that the plug and jack of the invention are compatible with existing plugs and jacks. The plug will automatically, introduce capacitance into the circuitry when the jack with which it is being used is a prior art jack. The jack will automatically remove capacitance from the circuitry when the plug of the invention is inserted therein. Thus, the plug and jack of the present invention exhibit "backward compatibility." In FIG. 3, there is shown a table depicting the industry standard allowable NEXT loss requirements at different frequencies and for different performance standard connectors, ANSI/TIA/EIA 568-A as promulgated by the Telecommunications Industry Association. In the table, the dB values given are, in all cases, negative values, and represent the worst-pair NEXT loss. It can be seen that the allowable loss, at 16 MHz, for a low performance connector (Category 3) is-34 dB, whereas, for a higher performance connector (Category 5) it is-56 dB, a much better performance figure. At the present time, new standards are in the process of being established for even higher categories of connectors, hence the term "high performance" and it is to these connectors that the present invention is primarily directed.

"Backward compatibility" is, at present, being explored in the prior art, and proposals exist for achieving it. In a monograph entitled "Connectors With Accessed Quality For Use In D.C., Low Frequency Analogue, And In Digital High Speed Data Applications, IEC 61076-X-Y, issued by the International Electrotechnical Commission, there are shown several suggested arrangements for achieving compatibility among plugs and jacks. Most of the jacks and plugs therein disclosed rely upon switching, either manually or automatically, between two different wiring schemes, whereas the present invention, as will be apparent hereinafter, relies upon the introduction or removal of capacitance or other current elements from the components or components of the connector system.

Figure 4:
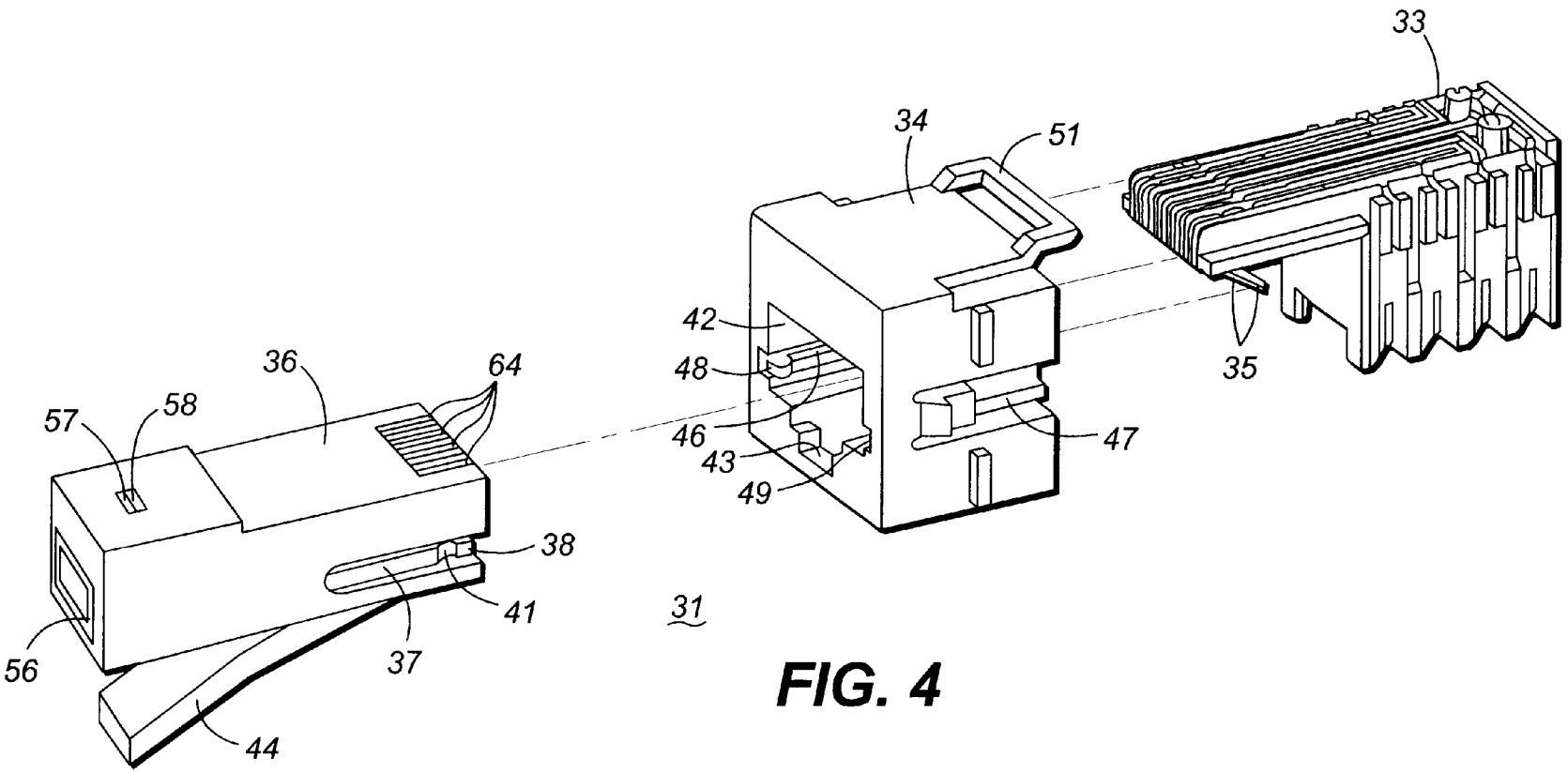
FIG. 4 is an exploded perspective view of a connector assembly which embodies the unique plug and unique jack of the present invention.

In FIG. 4 there is shown the connector assembly 31 of the present invention which comprises a jack 32 having a spring block assembly 33 having a plurality of depending spring wires 35 and a jack frame 34, and a plug 36 for use in high performance e.g. high speed data operation, but automatically adaptable for use in low performance, e.g., low frequency analog operation. Both jack 32 and plug 36 are configured and wired for high performance operation in anticipation of the new parametric standardized requirements, and, as such, exhibit low crosstalk operation. As will be seen more clearly hereinafter, plug 36 has mounted therein a translationally movable printed wiring board or other capacitance source 37 having a plurality of capacitance contact pads. Wiring board (PWB) 37 is preferably planar, and has a front end 38 and a rear end 39 as well as two sides on either side of PWB 37. Adjacent the front end thereof are first and second notches 41, only one of which is shown, which, as will be explained more fully hereinafter, are part of the mechanism by which the PWB 37 is moved in translation between first and second positions.

Jack 34 has a substantially hollow interior having an opening 42 for receiving plug 36, including a latching notch 43 for engaging latching components (not shown) on plug latching arm 44, to lock plug 44 in place after insertion in jack 34. Jack 34 has located therein first and second cantilevered spring arms 46 and 47, each of which has, at its distal end, a notch engaging portion 48 and 49, respectively. Jack 34 also has a latching member 51 for engaging and securing spring block 33.

In operation, PWB 37 is in its first, or low performance position within plug 36 prior to insertion into jack 34, as shown in FIG. 4. When the plug is inserted into high performance jack 34, portions 48 and 49 of spring arms 46 and 47 engage notches 41,41 on PWB 37 and prevent it from moving forward with plug 36. Thus, as plug 36 is inserted into jack 34, PWB 37 is moved translationally relative to plug 36 to the rear thereof, its second, or high performance position. As will be discussed hereinafter, the wires (or blades) within the plug, in the second position, do not contact the capacitance pads, hence capacitance is removed from the connection and the assembly functions as a high performance connector.

When the plug 36 is pulled out of jack 34, the arms 46 and 47 prevent the PWB 37 from moving, hence it is translated toward the front end of the plug until it butts against the front end wall. Continued pulling of plug 36 causes the arms to release PWB 37 and it is left in the first, or low performance, position, with the wires contacting the capacitance pads. In this first position, the plug 36 functions as a low performance plug useable with a low performance jack. In the second position the plug does not necessarily meet the electrical requirements per EIA 568 for a low performance plug.

Jack 34 can also be used as a low performance jack. When a typical low performance plug is inserted therein, the arms 46 and 47 are forced into recesses in the sides of the jack and have, in this position, no function.

Plug

Figure 5A:
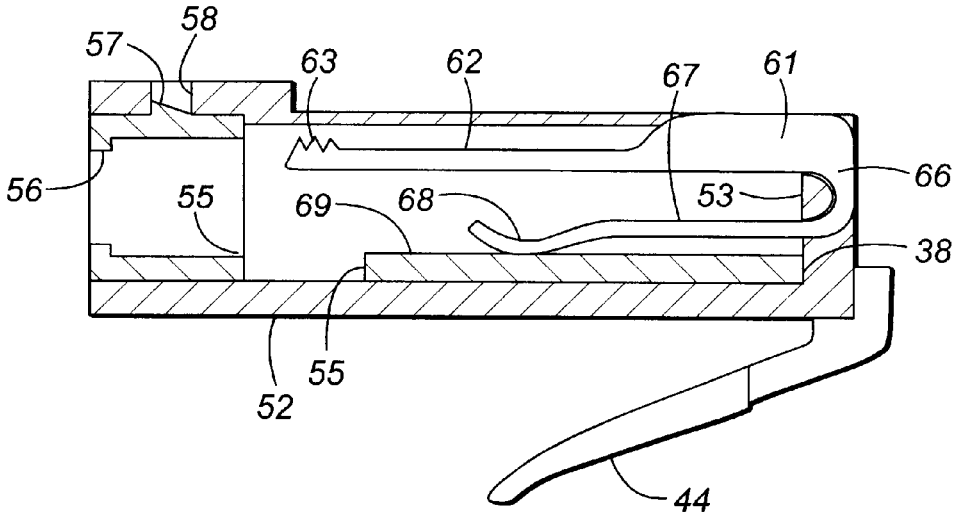
FIG. 5*a* is a cross-sectional elevation view of the plug of the invention in its low performance configuration.
Figure 5B:
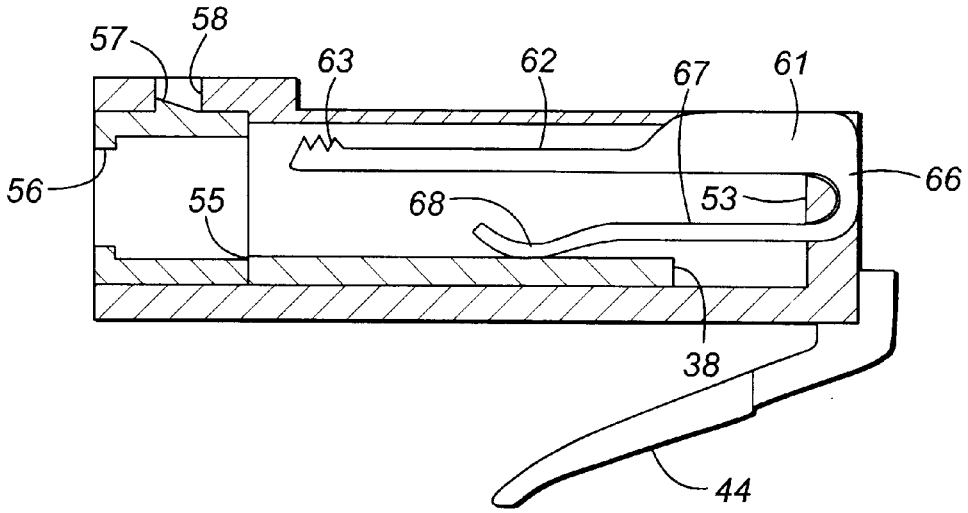
FIG. 5*b* is a cross-sectional elevation view of the plug of the invention in its high performance configuration.
Figure 6:
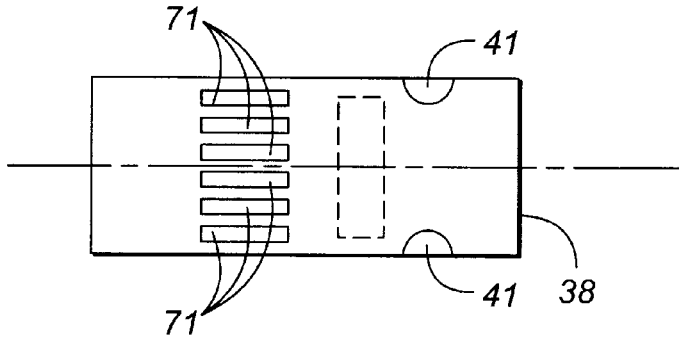
FIG. 6 is a top plan view of the PWB of the invention.

In FIGS. 5*a*, 5*b*, and 6, the plug 36 and PWB 37 of the invention are shown in greater detail. FIG. 5*a* depicts, in a cross-sectional view, the structural details of the plug 36 of the invention and their orientation in the first, or low performance, position. FIG. 5*b* depicts those elements of the plug 36 in the second, or high performance, position. As can be seen in the figures, the PWB 37 rests upon the floor 52 of the plug 36 and is slideable thereon. In the first position, the front end 38 of PWB 37 butts against the rear of the front wall 53 of the plug. The wall 53, as can be seen in FIGS. 5*a* and 5*b* affords a small amount of clearance for blades 61 so that they may be bent down slightly under pressure from the spring contacts to increase the pressure on PWB 38, as discussed in the foregoing. Contact members 61 preferably in the form of blades, each have a distal end 62 having a plurality of teeth 63 for making electrical contact with wires (not shown) from the cable (not shown) terminated by plug 36. At the front end of the plug, the blades 61 are located in slots 64 at the front of the plug for making electrical contact with the depending wire springs 35. Each blade 61 has a U-shaped bend 66 and a reentrant contact leg 67 which has, at its distal end, a contact bend 68 which bears against the top surface 69 of PWB 37. With reference to FIG. 6, in the position shown in FIG. 5*a*, the first position, contact bends 68 bear against capacitance pads 71 and are in electrical contact therewith. Also, as seen in FIG. 6, PWB 37 has slot 56, which has ends 54 and 55, located therein, as shown. It is to be understood that, while only six capacitance pads 71 are shown, the number may be four, eight, twelve, or however many cable wires are being connected.

In FIG. 5*b*, PWB 37 is shown in its second, or high performance position. In this position, which obtains when plug 36 is inserted into jack 34, contact bends 68 make contact with the surface 69 of PWB 37 in the region shown in dashed lines in FIG. 6. The PWB 37 and plug 36 are moved relative to each other during insertion of the plug 36 into jack 34 by the action of the arms 46 and 47 and notch engaging portions 48 and 49 positively engaging notches 41,41 on PWB 37, as explained hereinbefore. The effective rearward movement of PWB 37 within plug 36 is limited by the rear end 55 of PWB 38 butting against a stop insert 56 which is latched within the rear of plug 36 by suitable latching member 57 within a slot 58 in the body of plug 36, as shown. The insert 56 prevents PWB 69 from slipping out of plug 36. In use, arms 46 and 47 control the extent of translational movement, and retain their grip on the PWB 37 while it remains in jack 34. As was pointed out previously, this grip is also retained as the plug 36 is pulled from the jack, thereby returning the PWB 37 to the first position, shown in FIG. 5*a*.

While capacitance pads 71 are shown as simple capacitance plates, it is to be understood that surface 69 may have actual circuitry thereon (not shown) such as, for example, interdigitated capacitors or other circuit components that may be useful in achieving the desired ends. The structure of the plug and the PWB is such that both top and bottom surfaces might have different circuits thereon for different situations, in which case the PWB 37 can be removed from the plug, flipped over, and remounted in the plug. This feature also allows for different performance levels of plugs to be manufactured by installing PWBs or other capacitance sources with differing circuitries. This imparts a measure of versatility to the connector.

Jack

Figure 7A:
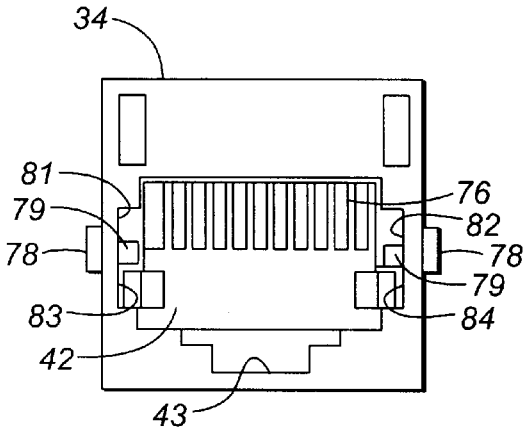
FIG. 7*a* is a front elevation view of the jack of the invention.
Figure 7B:
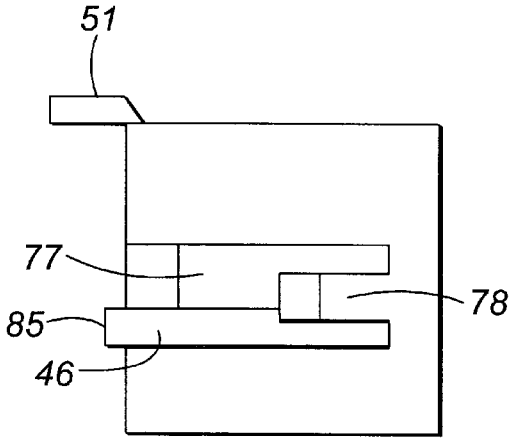
FIG. 7*b* is a side elevation view of the jack.
Figure 7C:
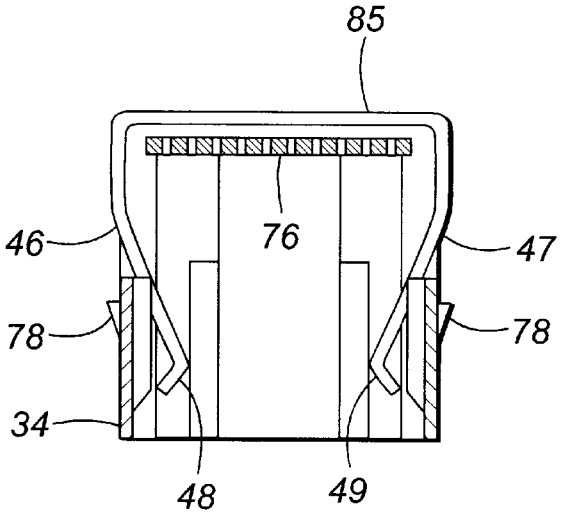
FIG. 7*c* is a cross-sectional top plan view of the jack.
Figure 8:
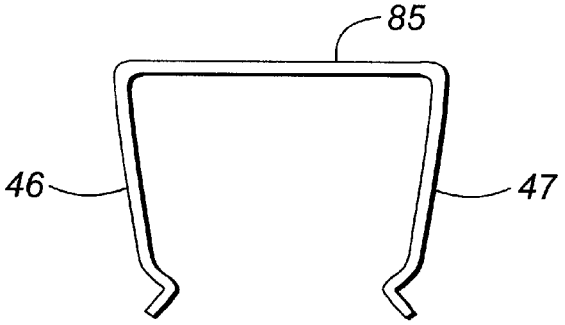
FIG. 8 is a plan view of the spring arm member for use in the jack of FIG. 7.

In. FIGS. 7*a*, 7*b*, and 7*c* there is shown a preferred embodiment of the jack 34 for use with the plug 36. For consistency like parts bear the same reference numerals as in previous figures. As best seen in FIG. 7*a*, jack 34 has an opening 42 in the front or connector face thereof leading to a substantially hollow interior, for receiving plug 36 (or a conventional low performance plug). Opening 42 has a latching notch 43 for engaging latching members on plug latching arm 44. AT the rear of the jack is a slotted wall 76 for receiving and aligning the spring contacts 35 on spring block 33. On either side of jack 34 is an opening 77, only one of which is shown in FIG. 7*b*, within which is a cantilevered latch arm 78 for mounting and latching jack 34 to a panel or whatever element, such as, for example, a face plate 11, shown in FIG. 1. It is to be understood that other arrangements for mounting jack 34 in its intended position may be used. However, the cantilevered latching arms 78,78 are one of the preferred mounting arrangements. On the inner sides of the latching arms 78,78 are elongated projections 79,79 which, together with recesses 81 and 82 in the jack body 34 form recesses 83 and 84. First and second spring arms 46 and 47, which, as shown in FIG. 8, are the arms of a U-shaped member 85 of suitable spring material such as beryllium-copper are positioned, as best shown in FIG. 7*a* and 7*c*, within the jack 34 so that their distal ends are adjacent the front face of jack 34 and so that, under pressure, they can be pressed into recesses 83 and 84. As best seen in FIGS. 7*b* and 7*c*, the U-shaped member 85 straddles the rear of plug 34 and arms 46 and 47 project into the interior of jack 34. The distal ends of the two spring arms 46 and 47 end in notch engaging portions 48 and 49 respectively, for positively engaging the notches 41,41 on PWB 37, as explained hereinbefore. The spring block 33, when inserted into the rear of jack 34, bears against member 85 to hold it in place. It is to be understood that other arrangements for mounting the spring arms may be used without departure from the scope of the present invention.

As was pointed out hereinbefore, if a standard, low performance plug is inserted into jack 34, the spring arms 46 and 47 will be forced into the recesses 83 and 84 into a "stowed" position where they perform no function and jack 34 functions as a low performance jack.

The connector arrangement of the invention is a relatively simple device for making high performance connections, yet each of the components thereof, i.e. the plug and the jack, can function independently as a low performance component of low performance connector.

In concluding the detailed description, it should be noted that it will be obvious to those skilled in the art that many variations and modifications may be made to the preferred embodiment without substantial departure from the principles and scope of the present invention. All such variations and modifications are intended to be included herein as within the scope of the present invention as set forth in the following claims. Further, in the claims hereafter, the corresponding structures, materials, acts, and equivalents of all means or step plus function elements are intended to include any structure, material, or acts for performing the functions with other elements as specifically claimed.

I claim:

1. A selectable compatibility connector assembly comprising:

a first member comprising an elongated plug and a second member comprising a jack for receiving said plug;

said plug having a circuit member therein movable in longitudinal translation relative to said plug between a first position and a second position and having at least one contact lead in contact with said circuit member;

said circuit member having a first region thereon containing circuit elements and a second region thereon substantially free of circuit elements; and said jack having actuating members therein for positively gripping said circuit member and moving said circuit member in translation to said second position when said plug is inserted into said jack and for gripping and moving said circuit member to said first position when said plug is withdrawn from said jack.

2. A connector assembly as claimed in claim 1 wherein said contact leads is in contact with said first region of said circuit member when said circuit member is in said first position.

3. A connector assembly as claimed in claim 1 wherein said contact leads is in contact with said second region of said circuit member when said circuit member is in said second position.

4. A connector assembly as claimed in claim 1 wherein said circuit member is a substantially planar member having first and second sides and a front and a rear end, and notches in said sides in proximity to said front end.

5. A connector assembly as claimed in claim 4 wherein said actuating members comprise first and second cantilever spring arms having distal ends adapted to engage and grip said notches.

6. A connector assembly as claimed in claim 5 wherein said jack has an opening therein for receiving said plug, and said spring arms are located on either side of said opening.

7. A connector assembly as claimed in claim 6 wherein said jack has first and second recesses for receiving and stowing said actuating arms when a low performance plug is inserted into said jack.

8. A selectable compatibility connector assembly comprising:

a first member comprising an elongated substantially hollow plug for terminating a conductor cable;

a second member comprising a substantially hollow jack having an opening therein for receiving said plug and having at least one spring contact therein;

said plug having a circuit member therein having first and second ends and movable in translation within said plug between a first position and a second position, said circuit member having a first region on a surface thereof containing circuit elements and a second region on said surface substantially free of circuit elements;

a plurality of elongated contact leads within said plug, each of said leads having a first end adapted to be connected to a conductor of the cable and a second end having a contact portion in contact with said surface of said circuit member, each of said leads further having a region between said first and second ends adapted to contact one of said spring contacts in said jack;

said jack having at least one actuating member adapted to engage and grip said circuit member when said plug is inserted in said jack and move it from said first position to said second position.

9. A connector assembly as claimed in claim 8 wherein said contact portion of at least one of said contact leads is in contact with said first region of said circuit member when said circuit member is in said first position.

10. A connector assembly as claimed in claim 8 wherein said contact portion of at least one of said contact leads is in contact with said second region when said circuit member is in said second position.

11. For use in a connector assembly comprising a plug for terminating an end of a conductor cable and a jack having an opening therein for receiving the plug;

a plug member comprising a substantially hollow elongated plug body having front and rear ends and an interior wall at said front end, said rear end having an opening therein;

a circuit member having front and rear ends and being movable in longitudinal translation within said plug between first and second positions, said circuit member having a first surface;

contact leads extending from adjacent said rear end to said front end and having a U-shaped portion at said front end for contacting spring contacts in the jack;

said contact leads each having a portion in contact with said first surface of said circuit member, and said circuit member having first and second sides, having notches therein for positively engaging a portion of the jack when the plug is inserted into the jack for movement from said first position to said second position and for movement of said circuit member from said second position to said first position when said plug is withdrawn from the jack.

12. A plug member as claimed in claim 11 wherein the front end of said circuit member bears against said interior wall when in said first position.

13. A plug member as claimed in claim 11 and further comprising a stop insert member mounted in said opening in said rear end of said plug body.

14. A plug member as claimed in claim 13 wherein said rear end of said circuit member bears against said stop insert when in said second position.

* * * * *